US010735859B2

(12) United States Patent
Kwiram et al.

(10) Patent No.: US 10,735,859 B2
(45) Date of Patent: Aug. 4, 2020

(54) LINE ARRAY SPEAKER WITH FREQUENCY-DEPENDENT ELECTRICAL TAPERING OPTIMIZED FOR MIDRANGE AND HIGH FREQUENCY REPRODUCTION IN THE NEARFIELD

(71) Applicant: Helikon Acoustics, LLC, San Francisco, CA (US)

(72) Inventors: Andrew Brandt Kwiram, Piedmont, CA (US); Joachim Gerhard, Brilon (DE)

(73) Assignee: LAMASSU LLC, San Jose, CA (US)

( * ) Notice: Subject to any disclaimer, the term of this patent is extended or adjusted under 35 U.S.C. 154(b) by 0 days.

(21) Appl. No.: 14/720,156

(22) Filed: May 22, 2015

(65) Prior Publication Data

US 2020/0169810 A1 May 28, 2020

(51) Int. Cl.

| | |
|---|---|
| ***H04R 3/14*** | (2006.01) |
| ***H04R 3/04*** | (2006.01) |
| ***H04R 1/02*** | (2006.01) |
| ***H04R 1/40*** | (2006.01) |

(52) U.S. Cl.

CPC ..... *H04R 3/14* (2013.01); *H04R 1/025* (2013.01); *H04R 1/403* (2013.01); *H04R 3/04* (2013.01); *H04R 2201/403* (2013.01)

(58) Field of Classification Search

CPC ..... H04R 3/14; H04R 1/025; H04R 1/403; H04R 3/04; H04R 2201/403

See application file for complete search history.

(56) References Cited

U.S. PATENT DOCUMENTS

| | | | | |
|---|---|---|---|---|
| 6,513,622 | B1 * | 2/2003 | Gelow | H04R 1/26 181/152 |
| 2006/0018490 | A1 * | 1/2006 | Stiles | H04R 1/26 381/87 |
| 2006/0018491 | A1 * | 1/2006 | Stiles | H04R 1/403 381/97 |
| 2006/0159286 | A1 * | 7/2006 | Stiles | H04R 1/26 381/111 |
| 2006/0159287 | A1 * | 7/2006 | Stiles | H04R 1/26 381/111 |
| 2006/0159289 | A1 * | 7/2006 | Stiles | H04R 1/26 381/111 |
| 2006/0182298 | A1 * | 8/2006 | Stiles | H04R 1/403 381/335 |

(Continued)

*Primary Examiner* — David L Ton

(74) *Attorney, Agent, or Firm* — Squire Patton Boggs US LLP

(57) ABSTRACT

A speaker system is provided having a line array of drivers wired in parallel and treated with passive or active component systems that serve to electrically taper its effective radiating length with frequency so that it is long/tall at low frequencies and short at higher frequencies, with the effective length of the array determined so as to maintain a listener in the nearfield at typical home and studio listening distances while minimizing the destructive effects of path-length dependent high frequency comb filtering. In alternate embodiments, an array of drivers is provided and wired in series or series-parallel with passive components between the output of one driver and the input of the next. Schemes of active drive and combination schemes of active and passive drive are also contemplated.

22 Claims, 8 Drawing Sheets

(56) References Cited

U.S. PATENT DOCUMENTS

| | | | | |
|---|---|---|---|---|
| 2007/0086606 | A1* | 4/2007 | Goodwin | H04R 1/40 381/116 |
| 2007/0263894 | A1* | 11/2007 | Stiles | H04R 1/403 381/335 |
| 2011/0142258 | A1* | 6/2011 | Beer | H04R 3/04 381/98 |
| 2013/0336505 | A1* | 12/2013 | Button | H04R 3/12 381/303 |
| 2014/0219480 | A1* | 8/2014 | Collins | H04R 3/14 381/300 |
| 2014/0286510 | A1* | 9/2014 | Alexander | H04R 1/26 381/182 |
| 2015/0189439 | A1* | 7/2015 | Starobin | H04R 3/12 381/303 |
| 2015/0312693 | A1* | 10/2015 | Collins | H04R 3/14 381/300 |
| 2017/0251296 | A1* | 8/2017 | Smithers | H04R 1/24 |

* cited by examiner

| | | Listening distance, meters | | | |
|---|---|---|---|---|---|
| | | 3.0 | 4.0 | 5.0 | 6.0 |
| | 500 | 2.00 | 2.31 | 2.58 | 2.83 |
| | 750 | 1.63 | 1.89 | 2.11 | 2.31 |
| | 1,000 | 1.41 | 1.63 | 1.83 | 2.00 |
| | 1,500 | 1.15 | 1.33 | 1.49 | 1.63 |
| Frequency, Hz | 2,000 | 1.00 | 1.15 | 1.29 | 1.41 |
| | 2,500 | 0.89 | 1.03 | 1.15 | 1.26 |
| | 3,000 | 0.82 | 0.94 | 1.05 | 1.15 |
| | 3,500 | 0.76 | 0.87 | 0.98 | 1.07 |
| | 4,000 | 0.71 | 0.82 | 0.91 | 1.00 |
| | 5,000 | 0.63 | 0.73 | 0.82 | 0.89 |
| | 6,000 | 0.58 | 0.67 | 0.75 | 0.82 |
| | 7,000 | 0.53 | 0.62 | 0.69 | 0.76 |
| | 8,000 | 0.50 | 0.58 | 0.65 | 0.71 |
| | 10,000 | 0.45 | 0.52 | 0.58 | 0.63 |
| | 11,000 | 0.43 | 0.49 | 0.55 | 0.60 |
| | 12,000 | 0.41 | 0.47 | 0.53 | 0.58 |
| | 13,000 | 0.39 | 0.45 | 0.51 | 0.55 |
| | 14,000 | 0.38 | 0.44 | 0.49 | 0.53 |
| | 15,000 | 0.37 | 0.42 | 0.47 | 0.52 |
| | 16,000 | 0.35 | 0.41 | 0.46 | 0.50 |
| | 17,000 | 0.34 | 0.40 | 0.44 | 0.49 |
| | 18,000 | 0.33 | 0.38 | 0.43 | 0.47 |
| | 19,000 | 0.32 | 0.37 | 0.42 | 0.46 |
| | 20,000 | 0.32 | 0.37 | 0.41 | 0.45 |

FIG. 5

| Frequency Hz | Maximum array length to provide a path length difference in wavelengths of 1.25 | 1.50 | 1.75 |
|---|---|---|---|
| 500 | 5.5 | 6.1 | 6.7 |
| 750 | 4.4 | 4.9 | 5.3 |
| 1,000 | 3.8 | 4.2 | 4.6 |
| 1,500 | 3.1 | 3.4 | 3.7 |
| 2,000 | 2.7 | 2.9 | 3.2 |
| 2,500 | 2.4 | 2.6 | 2.8 |
| 3,000 | 2.2 | 2.4 | 2.6 |
| 3,500 | 2.0 | 2.2 | 2.4 |
| 4,000 | 1.9 | 2.0 | 2.2 |
| 5,000 | 1.7 | 1.8 | 1.98 |
| 6,000 | 1.5 | 1.7 | 1.8 |
| 7,000 | 1.4 | 1.5 | 1.7 |
| 8,000 | 1.3 | 1.4 | 1.6 |
| 10,000 | 1.2 | 1.3 | 1.4 |
| 11,000 | 1.1 | 1.2 | 1.3 |
| 12,000 | 1.1 | 1.2 | 1.3 |
| 13,000 | 1.0 | 1.1 | 1.2 |
| 14,000 | 1.0 | 1.1 | 1.2 |
| 15,000 | 1.0 | 1.1 | 1.1 |
| 16,000 | 0.9 | 1.0 | 1.1 |
| 17,000 | 0.9 | 1.0 | 1.1 |
| 18,000 | 0.9 | 1.0 | 1.0 |
| 19,000 | 0.9 | 0.9 | 1.0 |
| 20,000 | 0.8 | 0.9 | 1.0 |
| 22,000 | 0.8 | 0.9 | 0.9 |
| 24,000 | 0.8 | 0.8 | 0.9 |

FIG. 7

LINE ARRAY SPEAKER WITH FREQUENCY-DEPENDENT ELECTRICAL TAPERING OPTIMIZED FOR MIDRANGE AND HIGH FREQUENCY REPRODUCTION IN THE NEARFIELD

FIELD

The exemplary embodiments of the present invention relate to audio speakers. More specifically, the exemplary embodiments of the present invention relate to a linear array of identical or similar audio drivers employed to reproduce midrange and treble frequencies.

BACKGROUND

Line array speakers exhibit a number of advantages compared to point source designs. These advantages may include lower harmonic distortion compared to a speaker using a single drive element of the same type, as well as low-frequency directivity control and the creation of an extended nearfield zone. The nearfield zone is the area in which directly radiated sound predominates over sound reflected from room/hall boundaries, with attendant improvements in the clarity of reproduced sounds.

The beneficial directivity and nearfield effects of an array result from comb filtering, which is a combination of constructive and destructive interference. The constructive interference on-axis results, in the nearfield zone, in sound louder than would be obtained from an otherwise comparable point source design, while destructive interference off-axis results in cancellation and lower sound intensity than from a point source design.

The inherent low-frequency directivity control of line arrays has led to the widespread adoption of array designs particularly in large-venue sound reinforcement applications such as concert halls and stadiums in which it is important for power efficiency and clarity to direct relatively low frequency sound energy (in the range of 40-500 Hz) toward the audience. One drawback of an untapered array is however that at high frequencies the primary output lobe narrows significantly, which reduces the consistency of frequency response at audience positions not located within this primary lobe.

Array tapering schemes that have been deployed have therefore typically focused on achieving so-called constant beamwidth, i.e. managing the polar response of the speaker by narrowing the response at low frequencies so as direct soW1d energy toward the audience and to reduce the amount of delayed reflected sound reaching the audience; and by widening the response at high frequencies so as to maintain better matching of polar response with the low frequency output, thereby maintaining a more balanced frequency response across the widest possible angle of coverage.

For a variety of reasons, these tapering schemes have not focused on mitigating the inherent disadvantages of array comb filtering in the nearfield at high frequencies. These reasons include: (a) that the audiences in large venues typically are not placed in the nearfield, where high frequency comb filtering disadvantages are most pronounced; (b) that high frequency sounds are significantly absorbed over typical large-venue listening distances; and (c) that the disadvantages of nearfield high frequency comb filtering are most apparent when the reproduction quality is carefully optimized to create a stereo image for a single listener or small number of listeners, which is not of concern in large-venue sound reinforcement applications.

The ear is very sensitive to the arrival time and phase of high frequency sounds; the brain uses the arrival time and phase of high frequency sounds in particular to interpret spatial information. In home and studio applications optimized for quality of stereo image, very accurate reproduction of high frequency sounds is critical for the realistic reproduction of acoustic cues such as information about the dimensions and properties of the recording venue, localization of performers within the venue, etc.

Designers of loudspeakers for homes and audio studios have long sought to exploit the advantages of arrays, including the clarity provided by the nearfield effect. In the home or studio environment the distance from listener to speaker is typically short, often does not vary, and the listener often does not expect wide coverage of a large listening area, thereby presenting a much simpler set of required optimizations than in a sound reinforcement application.

However in home and studio applications the disadvantages of untapered line arrays are readily apparent, even when the listener is positioned within the primary lobe of the speaker's output. Home and studio listeners have consistently noted problems with arrays and quasi-arrays (e.g. tall panel speakers, whether electrostatic, planar magnetic, or ribbon type) such as acoustic image "stretch" along the axis of the array causing acoustic images to be inappropriately diffuse and large, the presentation of acoustic images at positions higher or lower in the sound field (closer to the ceiling or floor) than is realistic, and reductions in the ability to localize sounds precisely in comparison to the best point-source speak.er designs. These and related disturbances in the midrange and treble may also affect the perceived quality of lower midrange and bass sounds.

These deleterious effects of line arrays may result from progressively increasing comb filtering distortion at high frequencies, in which path length differences between the listener and various active points on the array become progressively larger in wavelength and phase terms with increasing frequency. While array comb filtering produces beneficial effects at lower frequencies (greater effective sensitivity and directivity compared to a point source using the same driver), as the reproduced frequency increases the path length differences between different points on the array to the listener become increasingly large in relation to the wavelength reproduced. A large number of effectively separate arrival times thus result for high frequency sounds, with the phase shift compared to the first-arrival sound steadily increasing as the source of the sound moves toward the ends of the array, creating comb filtering distortion. Thus the higher the frequency and the longer the array, the greater the disadvantage an untapered line array has over the point source from the perspective of multiple arrival times and comb filtering distortion.

Consider a vertical line array with radiating height of 2.5 meters positioned such that the listener's ears are 4 meters from the array at a height of 1.25 meters above the floor. The path length for unreflected sound from the middle of the speaker to the listener's ear is 4.0 meters, while by the Pythagorean theorem, the path length from both the top and bottom of the array will be 4.19 meters. This gives a path length difference of 0.19 meters from either top or bottom of the array to the listener compared to the path length from the middle of the array. At 100 Hz, the wavelength of the generated sound is 3.44 meters. The difference in path length in wavelength terms is therefore approximately 6% of the wavelength (0.19 meters divided by 3.44 meters). However at 15 kHz, the wavelength is 0.023 meters, meaning that the path length difference for the top or bottom of the array versus the middle of the array to the listener is more than a factor of 8 greater than the reproduced wavelength.

The listener in this example will perceive a low-frequency impulse as a coherent sound, but a 15 kHz sound will arrive at multiple different times. In psychoacoustic terms the listener does not consciously perceive the different arrival times as temporal problems, but as other forms of distortion as noted above.

Listeners in fact commonly find that the disadvantages of line arrays compared to point sources are rendered less objectionable or disappear entirely as the listener moves farther away from the speaker—that is, as the path length differences between the ends of the array and the middle of the array are reduced. However, by moving farther away from the line array to the point that path length differences are minimized, the listener removes him- or herself from the nearfield zone in which direct sounds predominate over reflected sounds.

Existing array designs for home and studio use have rarely employed electrical tapering or beam steering schemes. When these schemes have been employed, they have generally been either frequency independent, or frequency dependent with the intended effect of constant beamwidth as in sound-reinforcement applications. In practice these schemes have not removed the disadvantages at high frequencies of line arrays described above.

It is observed that the transition from nearfield, which comprises•primarily direct sound, to far field, comprising primarily reflected sound, occurs at a distance D approximately equal to 1.5 multiplied by the frequency reproduced (expressed in kHz), in turn multiplied by the length in meters of the array, squared, i.e., D=–1.5*f*h2

This implies that for a given nearfield listening position a longer array is required at low frequencies to place the listener in the nearfield than is required at high frequencies. A shorter array may be adequate to maintain the listener in the nearfield at high frequencies. A shorter array also geometrically reduces path length differences between the ends of the array and a listener at a fixed point. It may be possible to taper an array in a manner that minimizes or eliminates high frequency comb filtering distortion while maintaining a listener at typical home and studio listening distances in the nearfield zone.

It is therefore desirable to provide an invention that optimizes the effective radiating length of a line array speaker with increasing frequency so as to provide a nearfield listener at typical home or audio studio listening distances with the maximum array length possible (thereby maximizing the proportion of directly-radiated sound via the nearfield effect, as well as minimizing harmonic distortion) while simultaneously minimizing audible distortions from high frequency comb filtering, that is, minimizing the listener's perception of sounds emitted with psychoacoustically significant path length differences compared to the shortest path length from the speaker to the listener. Such an invention may in practice reduce or eliminate the perception of "stretched" images, inappropriate image location, and other problems typical of conventional line array or long panel or ribbon radiators, and thereby reduce or eliminate the primary objection many listeners have to line array speaker systems, while maintaining the described advantages of a line array design.

BRIEF DESCRIPTION OF THE DRAWINGS

The features and advantages of the present disclosure will be more fully understood with reference to the following detailed description when taken in conjunction with the accompanying figures, wherein:

FIG. 5 is a table showing the minimum required array length in meters to place the listener at the nearfield-farfield transition boundary for the indicated frequency in Hertz and the indicated listening distance in meters.

FIG. 7 is a table showing the maximum effective array length in meters permissible to create the specified path length difference from the ends of the array compared to the center of the array, by frequency.

SUMMARY

Figure 1:
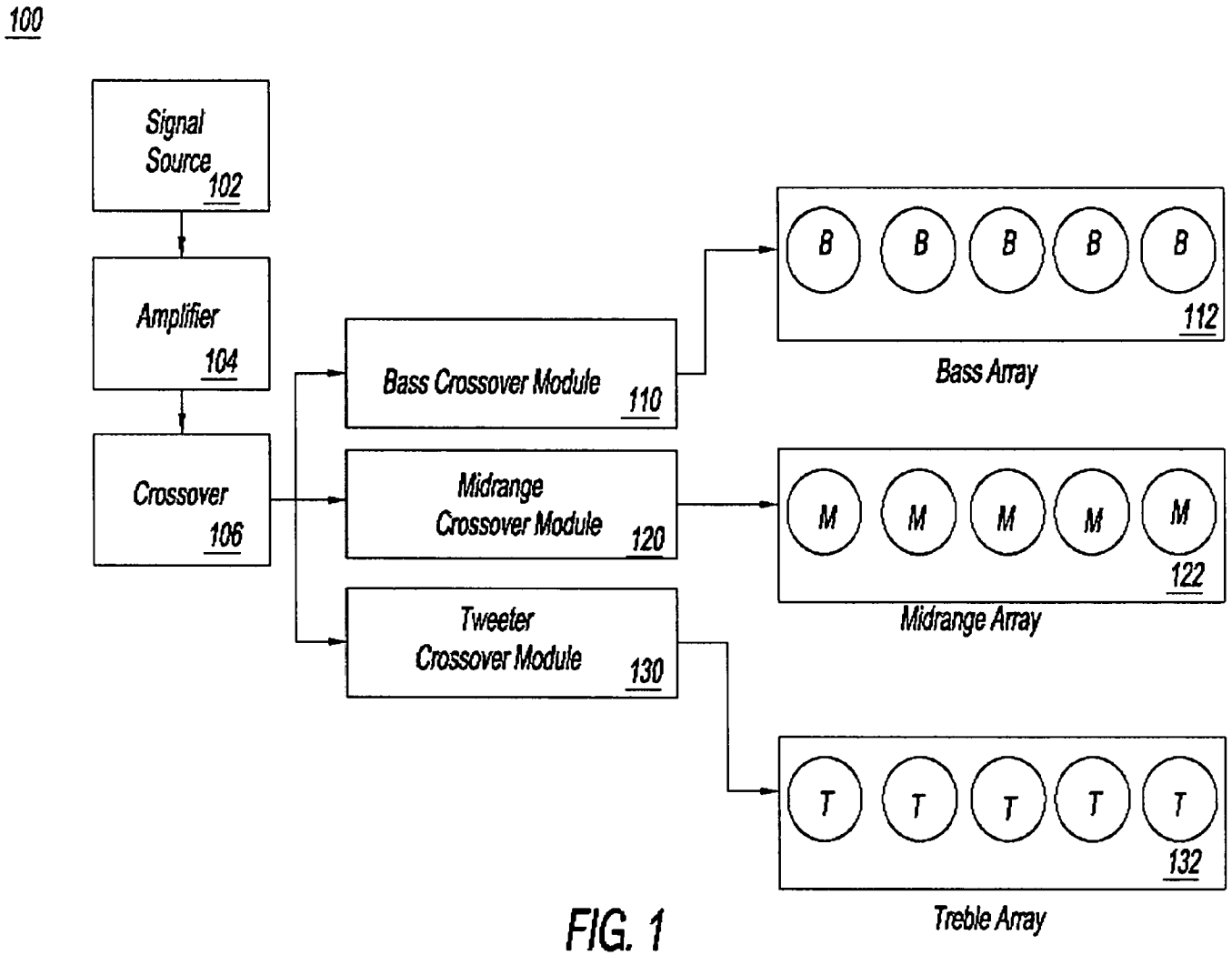
FIG. 1 is a block diagram showing an overview of an embodiment of the system of the present invention.

In embodiments, an audio speaker driver circuit is disclosed comprising an input terminal coupled to a high-pass crossover circuit, which crossover circuit is configured to attenuate portions of an audio signal that fall outside a predetermined frequency range, and output portions of an audio signal that fall within a predetermined frequency range. Audio speaker driver circuit may further comprise a line array of speaker drivers electrically coupled to the output of the crossover circuit, and a plurality of frequency-dependent filters selectively coupled to a subset of the speak.er drivers, where the level of frequency-dependent attenuation applied by the filters progressively decreases inward to the center of the line array.

In embodiments, various configurations are contemplated such as a high-pass crossover circuit, a low-pass crossover circuit, speaker drivers wired in parallel, and speaker drivers wired in series. In embodiments, the frequency-dependent filters are adjustable. In embodiments, speaker drivers closest to the center of the array are not electrically coupled to a frequency-dependent filter.

In embodiments, the path length difference between the listener and different points on the array may be limited to no more than approximately 2 full wavelengths for any reproduced frequency at a listening distance of between 2 and 10 meters.

In alternate embodiments, the crossover circuit may be configured to attenuate portions of an audio signal that fall outside a predetermined frequency range, and output portions of an audio signal that fall within a predetermined frequency range, thus maintaining the listener in the nearfield up to a predetermined frequency, and adjusting the effective radiating length of the array to an effective length shorter than is necessary to maintain the listener in the nearfield above said predetermined frequency.

DETAILED DESCRIPTION

The exemplary embodiments of the present invention relate to an audio speaker that can adjust its effective radiating length with frequency so that it is long at low frequencies and short at higher frequencies. In contrast to available tapered arrays, the present invention optimizes the tapering scheme specifically so as to maximize the array length while minimizing psychoacoustically important comb filtering distortions at midrange and treble frequencies, i.e. above approximately 500 Hz.

FIG. 5 shows, for several typical domestic and studio listening distances, the approximate minimum length in meters of the line array or other linear radiator required to place the listener at the nearfield/farfield transition boundary as it varies with frequency assuming a multiplier of 1.5 in the equation given in section 15 above. It will be seen that e.g. for a 4 meter listening distance, the required minimum array length is approximately 1.89 meters at 750 Hz but only 0.41 meters at 16 kHz.

Figure 6:
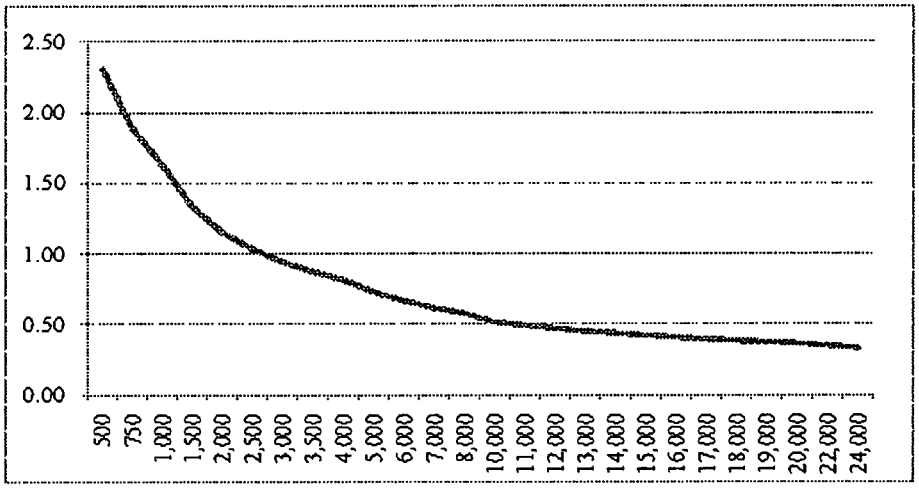
FIG. 6 is a chart showing the minimum approximate line array length in meters (Y-axis) required to place the listener at the nearfield-farfield transition for the indicated frequency in Hertz (X-axis) assuming a 4.0 meter listening distance

FIG. 6 shows the minimum line array length required to place the listener at the nearfield-farfield boundary for the 4.0 meter listening distance case. The Y-axis indicates the minimum required line length in meters while the X-axis plots the reproduced frequency in Hertz.

The maximum permissible array length beyond which comb filtering distortions become objectionable is not related to the nearfield-farfield transition distance. Rather, it is defined in psychoacoustic terms, i.e. by reference to experiments with different line lengths conducted by experienced listeners. In practice, experienced listeners begin to object to path length differences between the point on the array closest to the listener and points farther from the listener falling approximately between 1.25 and 1.75 wavelengths. Experienced listeners further find that perceived comb filtering distortion is minimized or eliminated once the sounds emitted from points on the array creating path length differences greater than described above are reduced in intensity by approximately 6 dB or more in relation to the unattenuated sound.

FIG. 7 shows the array lengths in meters, for a 4 meter listening distance, that result in the indicated path length differences in wavelength terms. Thus while the table shown in section 28 indicates that for sound at 8 kHz the minimum line length to place a listener (4.0 meters from the speaker) in the nearfield is approximately 0.58 meters, the psychoacoustic criterion separately defines, at a limit of 1.5 wavelengths of path length difference, a maximum permissible effective array length of approximately 1.4 meters. At 16 kHz the minimum required line length is approximately 0.41 meters while the maximum permissible effective array length assuming 1.5 wavelengths of path length difference is approximately 1.0 meters.

Figure 8:
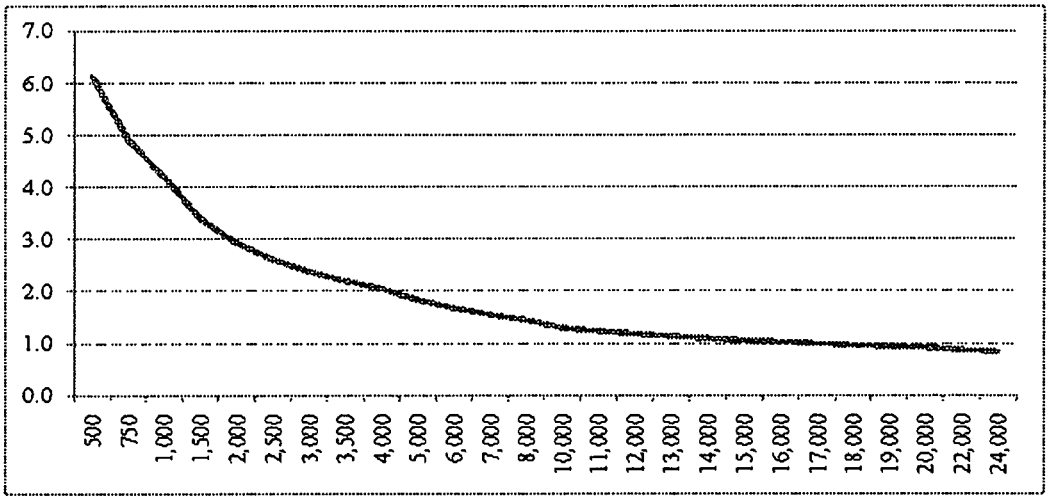
FIG. 8 is a chart showing the maximum psychoacoustically permissible array length in meters to minimize objectionable comb filtering distortion (Y-axis) for the indicated frequency in Hertz (X-axis), assuming a 1.5 wavelength path length difference limit and a 4.0 meter listening distance

FIG. 8 plots the maximum permissible array length, defined by the psychoacoustic criterion of no more than 1.5 wavelengths of path length difference between the line array and listener assuming a 4.0 meter listening distance.

In embodiments of the present invention, a line array with a frequency-dependent tapering scheme is provided that is long enough to place a typical home or studio listener in the nearfield at a given frequency (assuming typical home and studio speaker-to-listener distances of between 2 and 10 meters) but not so long as to create a path length difference greater than approximately 1.75 full wavelengths for any reproduced frequency between the listener and different points on the array. The tapering scheme reduces the sound output of array elements beyond the desired effective array length at a given frequency by at least 6 dB. Comb filtering and deleterious impacts to the quality of the reproduced sound are thereby minimized.

In embodiments, low-pass filters of varying onset point and slope may be placed symmetrically on drivers about the array midpoint, to provide frequency-dependent attenuation of signal that becomes progressively more pronounced as the distance of the driver in question increases in relation to the physical midpoint of the array. Such low-pass filters may be passive, such as a series-wired resistor and inductor, or a parallel-wired resistor and capacitor, or other such passive filters as may be familiar to those skilled in the art. The low-pass filters may also be active, such as line-level digital or analog filters applied to individual power amplifiers driving individual drivers or pairs of drivers equidistant from the midpoint of the array.

The detailed operation of an exemplary audio circuit according to embodiments of the present invention will now be shown. Referring to FIG. 1, a functional block diagram of a system according to embodiments of the present invention is shown.

An audio source 102 provides an audio signal to system 100. The audio source may be any conventional source such as a microphone feed, turntable, radio, compact disc player, SACD or Blu-Ray player, MP3 player, hard drive, or other digital source. The audio signal may be delivered to a crossover 106 that filters and routes portions of the audio signal within a predetermined frequency spectrum. For example, if the present invention were implemented with a tweeter array, crossover 106 may filter the full-range audio signal and deliver only the portion of the signal in, e.g., the 2,000-20,000 Hz frequency band. If used with a midrange speaker array, crossover 106 might deliver, e.g., only the portion of the signal in the 300-5,000 Hz frequency band.

Crossover 106 may then deliver the audio signal to a plurality of speaker drivers, a portion of which are each coupled to a filter that attenuates audio signals that are outside a predetermined frequency, the predetermined frequency depending on the driver's distance from the center of the array. As discussed herein, the type of drivers, number of drivers, type of filters, and the level of attenuation may vary depending on the specific application.

Figure 2:
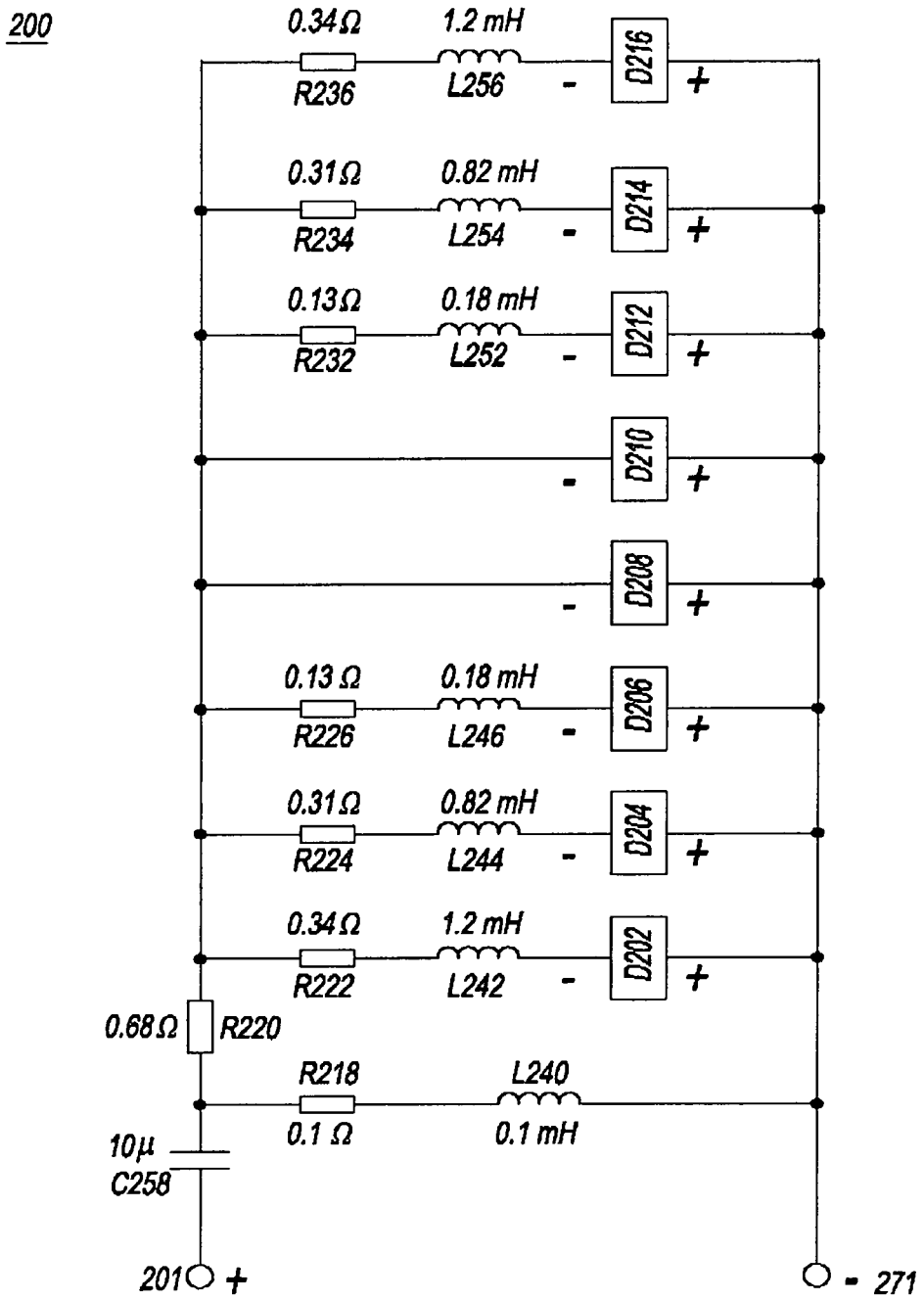
FIG. 2 is a circuit schematic showing an embodiment of the system of the present invention.

Referring to FIG. 2, an exemplary audio circuit 200 according is shown.

Circuit 200 may be implemented in any number of ways, including being integrated into a speaker enclosure, being integrated into an audio source, being provided as a standalone circuit board, or as a standalone unit positioned between an audio source and a speaker enclosure.

Circuit 200 may include input and output terminals 201, 271, a plurality of speaker drivers D202, D204, D206, D208, D210, D212, D214, and D216, which are wired in parallel and have an impedance of approximately 12 ohms. A plurality of resistors R222, R224, R226, R232, R234, R236 and a plurality of inductors 1242, 1244, 1246, 1252, 1254, 1256 form a series of RL filters that are selectively electrically coupled to a subset of the driver array.

While shown as a parallel-wired array, circuit 200 could also be implemented in series. It will be appreciated by those of skill in the art that the determination to use parallel or series wiring, or a combination thereof, will depend on the number of speaker drivers, the impedance of the speaker drivers, the power source, and other factors.

An audio signal may be received at input terminal 201. The audio source signal received at input terminal 201 may first be processed by a high pass second order crossover that is applied globally to the driver array. The high pass crossover may comprise, for example, a 0.68 Ohm resistor R220, a 0.1 Ohm resistor R218, a 0.1 mH inductor I240, and a 10 microFarad capacitor C258. The high pass crossover may process the audio signal, attenuating the signal at a predetermined threshold that depends on the application and the types of speaker drivers. For example, in the tweeter array shown in FIG. 2, the high pass crossover has a crossover frequency of approximately 3,000 Hz. Those skilled in the art will appreciate that the crossover frequency and slope will vary from application to application and can be varied by using different components for the high pass crossover. In alternate embodiments, the high pass crossover could be active rather than passive.

The attenuated audio source signal delivered by the high pass crossover may now be limited to a portion of the frequency spectrum that can be reproduced by the speaker drivers. The audio signal may then be fed in parallel to the plurality of filters and drivers along the line array.

As shown in FIG. 2, the resistors and inductors forming the RL filters provide the greatest attenuation at the outer bounds of the line array, with the frequency-dependent attenuation level progressively decreasing inward to the center of the line array where no further signal attenuation occurs before the audio signal is delivered to drivers D108, D210.

Referring to drivers D202 and D216, the audio signal is processed by a first RL filter pair comprising a 0.34 Ohm resistor (R222, R236) and 1.2 mH inductor (1242, I256). The RL filter pair provides frequency-dependent attenuation of the audio signal at a predetermined level consistent with the driver's position in the speaker array. In this embodiment, and with this level of resistance and inductance in combination with the impedance and other properties of the driver itself, audio signals exceeding approximately 3.1 kHz are attenuated (with a −3 dB point of 4.15 kHz and a slope of 6 dB/octave), and signals not exceeding that threshold are delivered to the associated drivers.

In parallel, the post-crossover audio signal may also be processed by the pair of RL filters comprising a 0.31 Ohm resistor (224, 234) and 0.82 mH inductor (244, 254). Here, signals exceeding approximately 4.5 kHz are attenuated (with a −3 dB point of 6.05 kHz and a slope of 6 dB/octave), and signals not exceeding that threshold are delivered to the associated drivers. Moving inward along the array, post-crossover audio signal may also be processed by the pair of RL filters comprising a 0.13 Ohm resistor (226, 232) and 0.18 mH (246, 252), providing attenuation where the frequency of the audio signal exceeds 21 kHz.

Lastly, drivers 0208 and 0210 are provided an audio signal that has had no further processing applied.

Drivers D202, D204, D206, 0208, 0210, 0212, 0214, and 0216 are preferably identical and, in the embodiment shown in FIG. 2, the drivers used will be, preferably, of the tweeter variety i.e., generally capable of reproducing sound in the 2,000-20,000 Hz frequency band, with a total unit length per tweeter of approximately 240 mm. In embodiments, drivers may be similar or identical, provided that all drivers are capable of reproducing audio frequencies in the target range.

The inductors and resistors used in embodiments of the invention may be any off-the-shelf commodity parts that are rated for the desired specification. It has been found that air-core copper inductors and wirewound resistors work with the invention, though any electrically comparable component will work.

Figure 3:
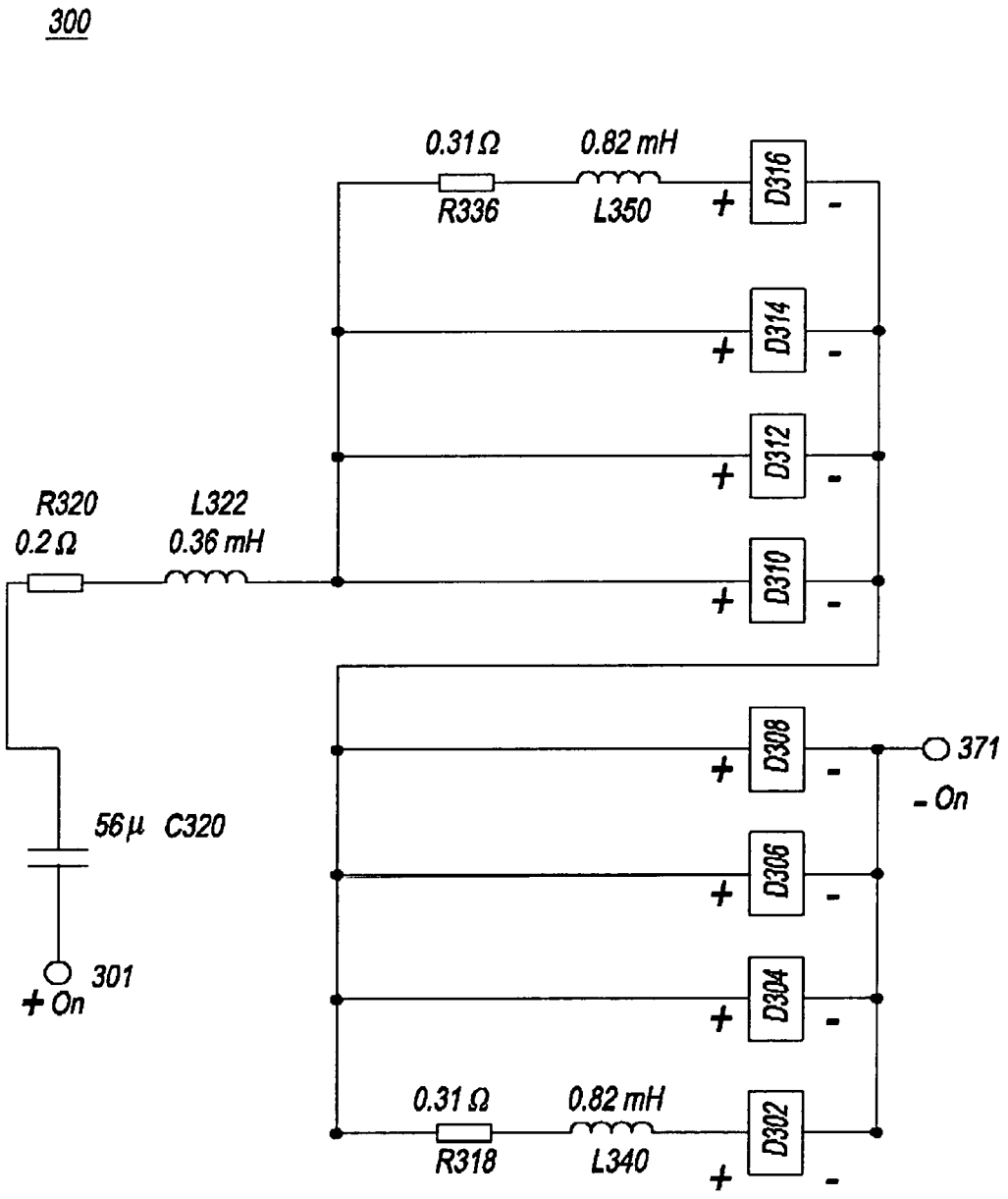
FIG. 3 is a circuit schematic showing an alternate embodiment of the system of the present invention.

Referring to FIG. 3, an alternate embodiment of the present invention is shown and which is, preferably, used to reproduce signals in the midrange band, i.e., 300-5,000 Hz.

Circuit 300 may include input and output terminals 301, 371, and a plurality of speaker drivers D302, D304, D306, D308. D310, D312, D314, and D316. Unlike the embodiment shown in FIG. 2, in circuit 300, the drivers are wired in two parallel segments that are in turn wired in series. It will be appreciated by those of skill in the art that wiring the drivers in series rather than in parallel is a design decision that may factor in the power of the amplifier driving circuit 300, the number of drivers in the array, the impedance of the drivers, and other factors. While shown as a parallel-series array, circuit 300 could also be implemented solely as a parallel- or series-wired array.

A plurality of resistors (R.318, R.336) and a plurality of inductors (1340, I356) form a series of RL filters that are selectively electrically coupled to a subset of the driver array. In the embodiment shown in FIG. 3, only the outermost drivers D302 and D316 are individually electrically coupled to an RL filter.

A signal may be received at input terminal 301. The audio source signal received at input terminal 301 is first processed by a crossover filter that is applied globally to the driver array. The crossover may comprise, for example, a 0.2 Ohm resistor R320, a 0.36 mH inductor I322, and a 56 microFarad capacitor C320. As with the embodiment of FIG. 2, the crossover may process the audio signal source, attenuating the signal at a predetermined threshold that depends on the application and the types of speaker drivers. For example, in the midrange array shown in FIG. 3, the crossover has a high-pass frequency of approximately 300 Hz. Those skilled in the art will appreciate that the crossover frequency and slope will vary from application to application and can be varied by using different passive components for the crossover. In alternate embodiments, the crossover could be active rather than passive.

The audio source signal delivered by the crossover may now be limited to a portion of the frequency spectrum that can be reproduced by the midrange speaker drivers. The audio signal may then be provided in series to the plurality of filters and drivers along the line array. As shown in FIG. 3, the resistors and capacitors forming the RL filters provide frequency-dependent attenuation at the outer bounds of the line array, with no attenuation applied to the interior drivers.

Referring to drivers D302 and D316, the audio signal is processed by an RL filter pair comprising a 0.31 Ohm resistor (R318, R336) and 0.82 mH inductor (I340, I350). The RL filter pair provides frequency-dependent attenuation of the audio signal at a predetermined level consistent with the driver's position in the speaker array. Here, frequencies exceeding approximately 1150 Hz may be attenuated while frequencies beneath that threshold will be passed to the associated drivers D302 and D316. The remaining drivers, D304, D306, D308, D310, D312, and D314, are fed an audio signal that has had no further processing applied.

Drivers D302, D304, D306, D308, D310, D312, D314, and D316 are preferably identical and, in the embodiment shown in FIG. 3, the drivers used will be, preferably, of the midrange variety and generally capable of reproducing sound in the 300-5,000 Hz frequency band, with a total unit length of approximately 250 mm per driver and an impedance of approximately 4 Ohms. In embodiments, rather than employing two arrays to reproduce midrange and tweeter frequencies separately, a single array could be employed comprising drivers able to reproduce the complete tweeter and midrange frequency spectrum, i.e. approximately 300 Hz-20,000 Hz.

As with the embodiment of FIG. 2, circuit 300 may be implemented in any number of ways, including being integrated into a speaker enclosure, being integrated into an audio source, or as a standalone unit positioned between an audio source and a speaker enclosure.

Similarly, it will be appreciated by those of skill in the art that the various embodiments of the present invention are not limited to any single type of filter for attenuating an audio signal at various positions along a line array. Any number of filters may be employed and remain within the scope of the invention including, for example, single order filters, series single order filters, second order filters, third order filters, fourth order filters, and other filter types familiar to those of skill in the art.

Similarly. the ratio and level of filtering that is applied to the drivers in the array may also be modified while keeping within the scope of the present invention. Rather than filtering the drivers symmetrically in the ratios described herein, asymmetrical filtering could be applied. Varying levels of impedance and resistance may be used and remain within the scope of the present invention.

In further embodiments, frequency-dependent attenuation may be achieved by means other than the single pole RL filter described above. For example, replacing the inductor used in each filter with a capacitor and resistor wired in parallel, but wired in series with the drivers, would produce a similar behavior. Alternatively, individual drivers could be driven directly from an amplifier incorporating equalization, either analog or digital.

In still further embodiments, a compact variant is contemplated in which the line array's effective length is sufficient at typical home or studio listening distances to place a listener in the nearfield at certain frequencies, but with increasing frequency tapers to an effective length shorter than is necessary to maintain the listener in the nearfield. While not providing all the described benefits of an optimal array, such a configuration—which contemplates a line array tapering to a single effective driver unit—may still provide nearfield or near-nearfield coverage at psychoacoustically important frequencies, with improved sound quality compared to both untapered arrays and to conventional point source designs. Compared to the acoustically optimal array described, such an array would present the advantages of smaller size and reduced cost.

For example, in a speaker with a 1 m treble array, the array may be long enough to place a listener 4 m from the speaker in the nearfield at approximately 2500 Hz-3000 Hz (while remaining short enough to reduce path length differences from different points on the array the array to the listener to 2 full wavelengths or less), and may then taper to a length shorter than is necessary (e.g. 0.1 meter or 0.2 meter) to maintain nearfield performance at 20 kHz. As another example, a 0.5 m array may be sufficient to place a listener at 4 m in the nearfield at 10 kHz, and may taper to a length shorter than necessary to maintain nearfield performance at 20 kHz. The foregoing ranges are exemplary only and a variety of ranges are contemplated.

Figure 4:
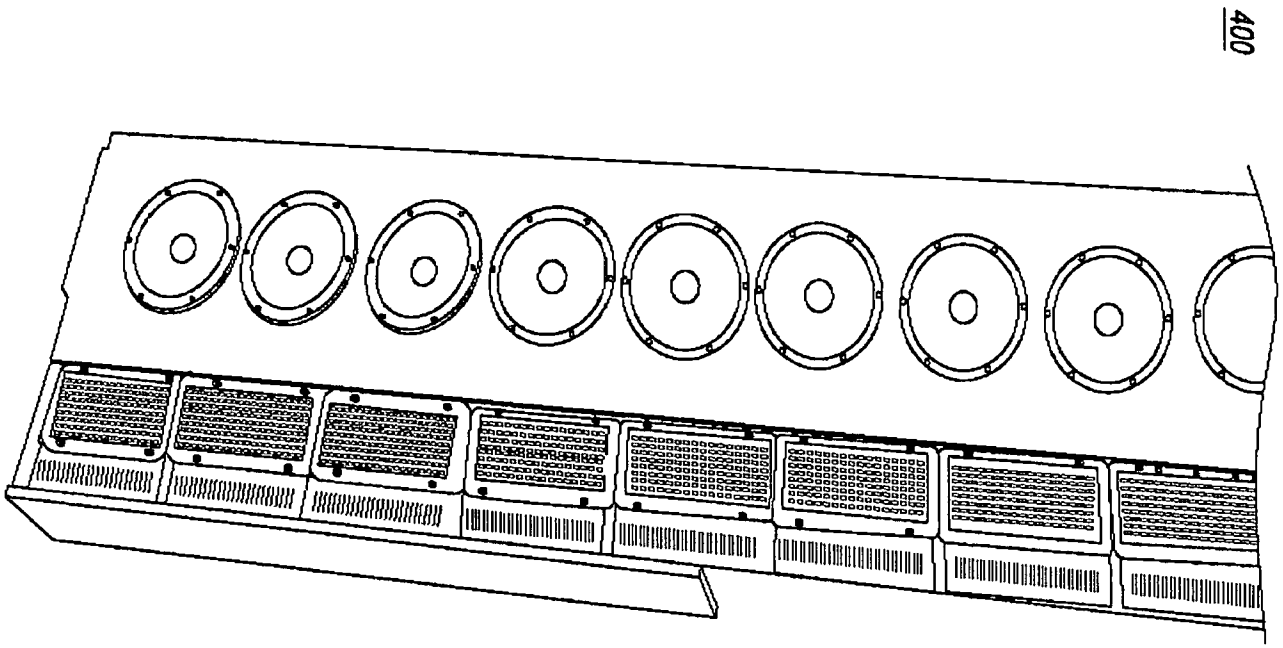
FIG. 4 is a diagram of an embodiment of the present invention mounted in a speaker enclosure.

Referring to FIG. 4. an exemplary speaker enclosure is shown with the drivers and circuitry of embodiments of the present invention integrated therein.

It will be understood that there are numerous modifications of the illustrated embodiments described above which will be readily apparent to one skilled in the art, such as increasing or decreasing the number of filters, the components comprising the filters, the crossover slope, the number of speaker drivers, and any other combinations of features disclosed herein that are individually disclosed or claimed herein, explicitly including additional combinations of such features. These modifications and/or combinations fall within the art to which this invention relates and are intended to be within the scope of the claims, which follow. It is noted, as is conventional, the use of a singular element in a claim is intended to cover one or more of such an element.

We claim:

1. An audio speaker driver circuit comprising: an input terminal coupled to a high-pass global filter circuit, said global filter circuit configured to attenuate portions of an audio signal that fall outside a predetermined frequency range, and output portions of an audio signal that fall within a predetermined frequency range;

a line array of speaker drivers electrically coupled to the output of said global filter circuit;

a plurality of frequency-dependent filters selectively coupled to a subset of said speaker drivers;

wherein the level of frequency-dependent attenuation applied by said filters progressively decreases inward to the center of the line array.

2. The audio speaker driver circuit of claim 1 wherein said high-pass global filter circuit and said plurality of frequency-dependent filters are implemented actively.

3. The audio speaker driver circuit of claim 1 wherein said high-pass global filter circuit and said plurality of frequency-dependent filters are implemented passively.

4. The audio speaker driver circuit of claim 1 wherein said global filter circuit is a high-pass crossover circuit.

5. The audio speaker driver circuit of claim 1 wherein said global filter circuit is a low-pass crossover circuit.

6. The audio speaker driver circuit of claim 1 in which, at a listening distance of between 2 and 10 meters, the listener is maintained in the nearfield for any frequency above 500 Hz while the path length difference between the listener and different points on said array is limited to no more than approximately 2 full wavelengths for any reproduced frequency above 500 Hz.

7. The audio speaker driver circuit of claim 1 wherein the speaker drivers closest to the center of the array are not electrically coupled to a frequency-dependent filter.

8. The audio speaker driver circuit of claim 1 wherein said speaker drivers are electrically coupled in series.

9. The audio speaker driver circuit of claim 1 wherein said speaker drivers are electrically coupled in parallel.

10. The audio speaker driver circuit of claim 1 wherein said frequency-dependent filters are adjustable.

11. A sound reproduction system, comprising:

a speaker line array comprising a plurality of drivers arranged about a center point;

a housing for said speaker line array;

an input terminal coupled to a global filter circuit, said global filter circuit configured to attenuate portions of an audio signal that fall outside a predetermined frequency range, and output portions of an audio signal that fall within a predetermined frequency range;

a plurality of frequency-dependent filters selectively coupled to a subset of said speaker drivers;

wherein the level of frequency-dependent attenuation applied by said filters progressively decreases inward to the center of the line array.

12. The sound reproduction system of claim 11 wherein said global filter circuit and said plurality of frequency-dependent filters are implemented actively.

13. The sound reproduction system of claim 11 wherein said global filter circuit and said plurality of frequency-dependent filters are implemented passively.

14. The sound reproduction system of claim 11 wherein said global filter circuit is a high-pass crossover circuit.

15. The sound reproduction system of claim 11 wherein said global filter circuit is a low-pass crossover circuit.

16. The sound reproduction system of claim 11 in which, at a listening distance of between 2 and 10 meters, the listener is maintained in the nearfield for any frequency above 500 Hz while the path length difference between the listener and different points on said array is limited to no more than approximately 2 full wavelengths for any reproduced frequency above 500 Hz.

17. The sound reproduction system of claim 11 wherein the speaker drivers closest to the center of the array are not electrically coupled to a frequency-dependent filter.

18. The sound reproduction system of claim 11 wherein said speaker drivers are electrically coupled in series.

19. The sound reproduction system of claim 11 wherein said speaker drivers are electrically coupled in parallel.

20. The sound reproduction system of claim 11 wherein said frequency-dependent filters are adjustable.

21. An audio speaker driver circuit comprising:

an input terminal coupled to a high-pass global filter circuit;

said global filter circuit configured to attenuate portions of an audio signal that fall outside a predetermined frequency range, and output portions of an audio signal that fall within a predetermined frequency range;

a line array of speaker drivers electrically coupled to the output of said global filter circuit;

a plurality of frequency-dependent filters selectively coupled to a subset of said speaker drivers;

wherein said filters adjust the effective radiating length of the array such that a listener at between 2 and 10 meters from the speaker is maintained in the nearfield at a predetermined frequency falling between approximately 2 kHz and 10 kHz;

and wherein said filters adjust the effective radiating length of the array such that the path length difference between the listener and different points on said array remains less than approximately 2 full wavelengths for any reproduced frequency above said predetermined frequency, but such that the effective length of the array tapers to a length shorter than necessary to maintain the listener in the nearfield at certain frequencies above said predetermined frequency.

22. A sound reproduction system, comprising:

a plurality of speaker drivers;

means for housing said speaker drivers;

means for attenuating portions of an audio signal that fall outside a predetermined threshold;

means for delivering said audio signal to said plurality of speaker drivers;

means for selectively applying frequency-dependent attenuation to said audio signal before it is applied to said speaker drivers;

wherein the level of frequency-dependent attenuation applied by said filters progressively decreases inward to the center of the line array.

* * * * *